United States Patent [19]

Quiring

[11] 4,355,466

[45] Oct. 26, 1982

[54] PUNCHING TOOL HAVING REPLACEABLE TIPS

[76] Inventor: Michael S. Quiring, 3100 Yukon Ave., North, Crystal, Minn. 55427

[21] Appl. No.: 236,142

[22] Filed: Feb. 20, 1981

[51] Int. Cl.[3] ..... B26F 1/32

[52] U.S. Cl. ..... 30/358; 279/96

[58] Field of Search ..... 279/96, 100, 102, 1 E, 279/101; 30/358, 367, 366; 29/240, 256, 264; 403/16

[56] References Cited

U.S. PATENT DOCUMENTS

| | | | |
|---|---|---|---|
| 1,104,044 | 7/1914 | Goetz | 279/101 X |
| 1,166,723 | 1/1916 | Stark | 30/358 |
| 1,412,469 | 4/1922 | Jimerson | 279/101 |
| 1,521,265 | 12/1924 | Anderson | 30/366 X |
| 1,761,207 | 6/1930 | Guertin | 30/358 |
| 2,080,526 | 5/1937 | Bedford | 279/96 X |
| 2,129,704 | 9/1938 | Meyer | 279/103 |
| 2,612,222 | 9/1952 | Sterba | 30/358 |
| 3,036,482 | 5/1962 | Kenworthy | 30/366 X |
| 3,100,545 | 8/1963 | Zimmerman | 279/96 X |

*Primary Examiner*—Jimmy C. Peters

[57] ABSTRACT

A punching tool having a solid barrel adapted for hand holding, and having at one barrel end a head for hammering, and at the other barrel end a tapered neck. A threaded nut is removably attached to the barrel intermediate the neck and second barrel end. A plurality of attachment tips are provided, each having an internal tapered bore sized to fit over the tapered neck of the second barrel end, and each is removable by rotation of the threaded nut on the barrel.

8 Claims, 6 Drawing Figures

PUNCHING TOOL HAVING REPLACEABLE TIPS

BACKGROUND OF THE INVENTION

This invention relates to punching tools, and more particularly to a punching tool having a plurality of tips for easy attachment and replacement. The invention is preferably adapted for use with a plurality of tips of softer metal than the metal used to formulate the tool body.

In the field of hand tools as it relates to punches, it is frequently necessary to discard tools that become deformed through heavy usage, for they are typically adapted with a head at one end for hammering against, and a shaped tip at the other end for punching metallic and other objects. Such tools can be reground to reshape the tip end after reasonable wear, but eventually they become deformed past the point of repair. This is particularly true in the case of punches having relatively soft metal tips, such as brass, which are needed in particular industrial applications. In these cases, the metallic tip ends cold flow as a result of the hammering action and render the tool useless after a relatively short life.

It is difficult to utilize a replaceable tip on such a tool, for the very hammering action use to which the tool is put forceably jams the tip against the tool end and makes removal of the tip difficult if not impossible

SUMMARY OF THE INVENTION

The present invention utilizes a solid shank or barrel having a head end adapted for hammering and having a tapered neck end adapted for seating into a tip of complementary shape. A threaded nut is located intermediate the tapered neck end and the tool body, and a pair of flats are provided on the tool body for rotatably holding the body with a standard wrench while the nut is threadably tightened or loosened. One or more replaceable tips are contemplated for use with the invention, and form a part thereof, the tips preferably being made from a metal which is softer than the body of the tool, and each tip having a tapered recess complementary-shaped to the tapered neck end of the tool for receiving the tool therein and seating the tip agains the tool.

It is therefore a principal object of the present invention to provide a hand punch having one or more replaceable tips.

It is another object of the present invention to provide a hand punch having a threaded member for easy removal of replacement tips.

It is a further object of the present invention to provide a hand punch and a plurality of soft metal tips adapted for easy attachment and replacement onto the hand punch.

BRIEF DESCRIPTION OF THE DRAWINGS

The foregoing and other objects will become apparent from the following specification and claims, and with reference to the appended drawings, in which:

DESCRIPTION OF THE PREFERRED EMBODIMENT

Figure 1:
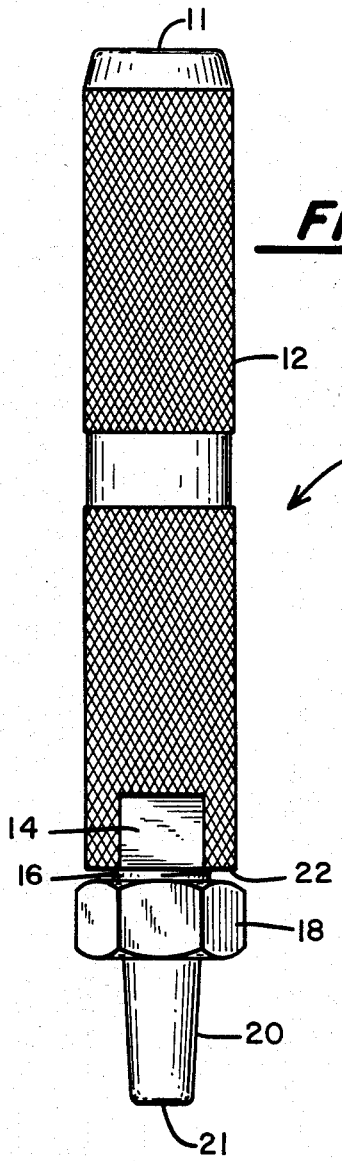
FIG. 1 shows an elevation view of the punch body.

Referring first to FIG. 1 there is shown a punch body 10 which is generally round in cross section, and is preferably constructed of steel. Punch body 10 has a head end 11 adapted for hammering, and has a knurled shank 12 adapted for ease of grasping by the hand. A pair of flat surfaces 14, 15 are formed near the lower end of the knurled surface 12, and are sized for accepting a standard wrench size. The lower end of body 10 is threaded at 16, and a nut 18 is threadably secured thereto. The neck end 20 is formed into a cone-shaped taper for purposes which will be hereinafter described.

Figure 2:
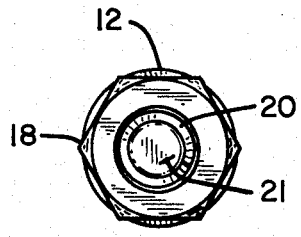
FIG. 2 shows a bottom view of the punch body of FIG. 1.

FIG. 2 shows an end view of punch body 10, wherein nut 18 has outside dimensions roughly equal to the diameter of shank 12.

Figure 3:
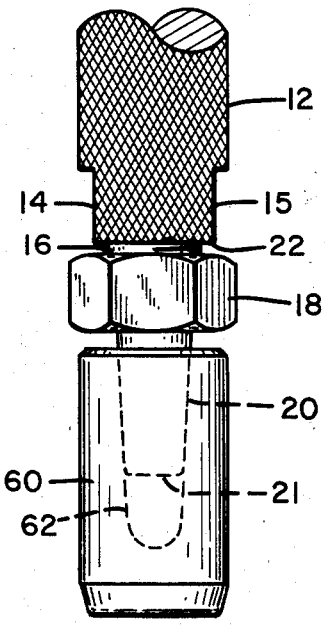
FIG. 3 shows a partial side elevation view of the punch body with a tip attached.

FIG. 3 shows a side elevation view, wherein flat surfaces 14 and 15 are illustrated. Threaded portion 16 is continued up to face 22, thereby permitting nut 18 to be threaded completely up into abutting contact with face 22. A typical replaceable tip 60 is shown on neck 20, wherein an interference fit exists between the inside tapered surface 62 of tip 60, and tapered neck 20. Tapered neck 20 extends into tip 60, but the length of tapered neck 20 is shorter than the depth of interior recess 62 so that the bottom face 21 of neck 20 does not reach the bottom of recess 62. When a replaceable tip such as tip 60 is to be secured to neck 20, nut 18 is first threaded on threads 16 to come into abutting contact with face 22.

Figure 4:
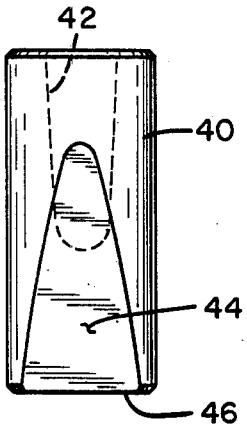
FIG. 4 shows one form of tip adapted for use on the punch body.
Figure 5:
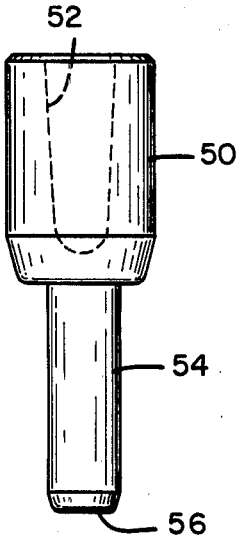
FIG. 5 shows another form of tip adapted for use on the punch body.
Figure 6:
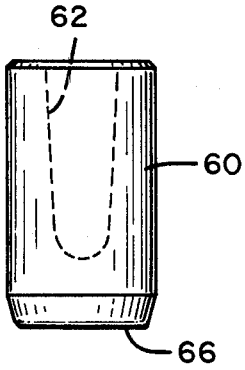
FIG. 6 shows another form of tip adapted for use on the punch body.

FIG. 4 shows by way of example a typical tip 40. Tip 40 has an internal tapered bore 42 which is sized for interference fitting over neck 20 of body 10. In the example shown by replacement tip 40, a pair of flat angular faces 44 are constructed to form a more or less narrowed tip end 46 which is useful in certain industrial punching applications. FIG. 5 shows a second alternative replacement tip 50, wherein a tapered bore 52 is sized for receiving neck 20 of tool body 10. Tip 50 has an extended narrowed shank 54 for particular punching operations. FIG. 6 shows yet another replacement tip configuration, wherein tip 60 has a similar internal bore 62 for fitting over tapered neck 20 of tool body 10. In this example, tip 60 has a flattened round punching face 66 for use in industrial applications.

In the preferred embodiment, each of the replacement tips of FIGS. 4–6 is formed of a relatively soft metal such as brass, whereas tool body 10 is formed of a hardened steel. However, replacement tips of the types shown in FIGS. 4–6, and other types, may also be formed of hardened steel, or any other convenient metal.

In operation, threaded nut 18 is first threaded to abut face 22 and to thereby expose the maximum length of tapered neck 20. Tool body 10 is then inserted into one of the replacement tips and head 11 is hammered to secure neck 20 into the tapered bore of the replacement tip. The tool is then used in the normal punching operations, and through such operations the replacement tip is securely wedged against neck 20. When a replacement tip is to be removed a first wrench is placed over flat surfaces 14, 15, and a second wrench is placed over nut 18. Nut 18 is then threadably loosened relative to shank 12 and thereby forceably removes the replacement tip from its interference fit against tapered neck 20. Once a replacement tip is removed threaded nut 18 is returned to its threaded relationship abutting face 22, and a new replacement tip is hammered onto the end of tool 10.

The present invention may be embodied in other specific forms without departing from the spirit or essential attributes thereof, and it is therefore desired that the present embodiment be considered in all respects a illustrative and not restrictive, reference being made to the appended claims rather than to the foregoing description to indicate the scope of the invention.

What is claimed is:

1. A punching tool adapted for accepting a plurality of punch tips, and a punch tip therefor, comprising:

(a) a punch body having a first end adapted for hammering, and having a second end formed into a decreasing conical taper;

(b) a threaded section on said punch body immediately adjacent said second end taper, and a nut threadably fastened only on said punch body for removing said tip by engagement of a facing surface of said nut with an end face of said punch tip; and (c) said punch tip having a conical recess therein, the depth of said recess being greater than the length of said punch body taper.

2. The tool of claim 1, wherein said punch body further comprises a steel cylindrical member.

3. The tool of claim 2, further comprising a pair of flat surfaces cut into opposite sides of said punch body and spaced to accept a common wrench size thereabout.

4. The tool of claim 3, wherein said punch body further comprises a surface having a knurl applied thereto.

5. The tool of claim 3, wherein said punch tip further comprises a tip made from brass.

6. The tool of claim 5, wherein said punch tip further comprises a cylindrical member having a diametrically opposed flat surfaces angled toward each other.

7. The tool of claim 5, wherein said punch tip further comprises a cylindrical member having a first section of one diameter and having a second end section of a reduced diameter.

8. The tool of claim 5, wherein said punch tip further comprises a cylindrical member having a flat end surface.

* * * * *